US005234714A

United States Patent [19]

Patel et al.

[11] Patent Number: 5,234,714

[45] Date of Patent: Aug. 10, 1993

[54] CHROMATE/SILICATE ALUMINUM SURFACE TREATMENT FOR HEAT EXCHANGERS

[76] Inventors: Bipin B. Patel, 1458 Wardmier Dr., Dayton; Steven J. Rasso, Jr., 3625 Twinbrook La., Kettering, both of Ohio 45429

[21] Appl. No.: 998,273

[22] Filed: Dec. 30, 1992

[51] Int. Cl.[5] ..... B05D 3/00

[52] U.S. Cl. ..... 427/327; 427/436

[58] Field of Search ..... 427/327, 436

[56] References Cited

U.S. PATENT DOCUMENTS 3,762,178 10/1973 Yamada et al. ..... 62/157

4,672,816 6/1987 Takahashi ..... 62/180

*Primary Examiner*—Bernard Pianalto

*Attorney, Agent, or Firm*—Kenneth H. MacLean

[57] ABSTRACT

A chromate/silicate surface treatment for providing an aluminum heat exchanger with a corrosive-resistent hydrophilic coating. The subject process includes sequentially immersing an aluminum heat exchanger in a series of chemical solutions. The chemical solutions include a cleaning solution, followed by a rinse solution, chromate solution, additional rinse solution, and a silicate solution. The chemical concentrations of the cleaning solution, chromate solution and silicate solution are precisely controlled in order to avoid producing a coating which emits a musty odor.

6 Claims, No Drawings

CHROMATE/SILICATE ALUMINUM SURFACE TREATMENT FOR HEAT EXCHANGERS

BACKGROUND OF THE INVENTION

Technical Field

The subject invention relates to a chromate/silicate surface treatment for providing an aluminum heat exchanger with corrosive-resistent hydrophilic coatings.

Heat exchangers, such as evaporators and radiators, are often surface treated with a chromate solution to provide a corrosive-resistant chrome coating thereon. Moreover, heat exchangers may be additionally treated with a silicate solution for providing a hydrophilic coating. The hydrophilic coating breaks the surface tension of water; thus, water tends to run off and not collect or bead-up on the surface of the heat exchanger.

Such a surface treatment is available from Circle-Prosco Inc., of Bloomington, Ind. The Circle-Prosco treatment process includes providing a plurality of liquid baths arranged serially in which an aluminum heat exchanger is sequentially immersed. More specifically, the Circle-Prosco process involves providing a cleaning bath including an aqueous acid cleaning solution. The acid cleaning solution includes 40–60 weight percent of nitric acid and 5–1 percent of sodium fluoride, (commercially available from Circle-Prosco as Acid Cleaner 8D). The acid cleaning solution is diluted with water so that the overall concentration of the acid cleaning solution in the cleaning is between 2.0–5.0 weight percent. The temperature of the cleaning solution is maintained between 120°–135° F.

At least one and preferable several rinse water baths are provided sequentially following the cleaning bath for rinsing the cleaning solution from the cleansed heat exchanger. Following the rinse water baths, a chromate bath is provided including an aqueous chromate solution. The chromate solution is an aqueous solution comprising 10 weight percent of chromium trioxide, 25 weight percent of nitric acid and 10 weight percent of hydrofluoric acid, (commercially available from Circle-Prosco as Alcoat 300 BD). The chromate solution is diluted with water so that the overall concentration of the chromate solution in the chromate bath is between 1.8–3.3 weight percent. The chromate bath further comprises a chromate activator including an aqueous solution of less than 25 weight percent of molybdic acid and disodium salt (commercially available from Circle-Prosco as Alcoat 300 AD). The chromate activator solution is diluted so that its overall concentration within the chromate bath is between 1.2–1.5 weight percent. The temperature of the chromate bath is maintained between 120°–135° F.

At least one and preferable several rinse water baths are provided sequentially following the chromate bath for rinsing the chromate solution from the chromed heat exchanger. Finally, a silicate bath is provided including a silicate liquid. The silicate liquid comprises 90–100 weight percent of silicate of soda and 0–10 weight percent of potassium hydroxide (commercially available from Circle-Prosco as Final Rinse 8D). The silicate liquid is diluted with water so that its overall concentration within the silicate bath is between 2.3–5.0 weight percent. The silicate bath is maintained between 155°–165° F.

The Circle-Prosco process includes immersing an aluminum heat exchanger within the cleaning bath to remove any oxidation from the heat exchanger. Subsequently, the heat exchanger is removed from the cleaning bath and immersed in the rinse bath(s) to remove any residual cleaning solution therefrom. Once rinsed, the heat exchanger is immersed within the chromate bath where it is provided with a chrome coating. Subsequently, the heat exchanger is removed from the chromate bath and immersed in the rinse bath(s) to remove any residual chromate solution therefrom. Finally, the heat exchanger is immersed within the silicate bath wherein the heat exchanger is provided with a hydrophilic coating. The heat exchanger is removed from the silicate bath and is then moved to a dry oven where the coatings on the heat exchanger are fully dried.

A common problem with heat exchanges, including those treated with the Circle-Prosco process or similar processes, is the emission of a musty odor.

Microscopic organisms are often present within heat exchangers due to the presence of moisture, and as a result, cause a musty odor to be emitted from the heat exchanger. As a consequence, much attention has been directed toward treatment of heat exchangers to prevent fungal growth. For example, U.S. Pat. Nos. 4,672,816 to Takahashi and 3,762,178 to Yamada disclose air conditioning systems wherein an air blower is pre-cooled prior to blowing cooled air into the passenger compartment in order to reduce musty odor problems. Further examples include the use of fungicides to prevent fungal growth.

Regardless of the use of fungicides or other remedial measures, heat exchangers treated with chromate/silicate processes as described above, continue to emit a musty smell.

SUMMARY OF THE INVENTION AND ADVANTAGES

The subject invention is a process for surface treating an aluminum heat exchanger by successively immersing the heat exchanger within a series of chemical solutions to provide the heat exchanger with a corrosive-resistent hydrophilic coating. The process comprising the steps of: providing a cleaning mixture including 40 to 60 weight percent of nitric acid and 1 to 5 weight percent of sodium fluoride, adding water to the cleaning mixture to form an aqueous cleaning solution having a total concentration of cleaning mixture between 2.0 to 5.0 weight percent at 120°–135° F.; providing a chromate mixture including 10 weight percent of chromium trioxide, 25 weight percent of nitric acid and between 10 to 11 weight percent of hydrofluoric acid, providing an chromate activator comprising less than 25 weight percent of molybdic acid and disodium salt, adding water and the chromate activator to the chromate mixture to form an aqueous chromate solution; and providing a silicate mixture comprising 90 to 100 weight percent of silicate of soda and 0 to 10 weight percent of potassium hydroxide, adding water to the silicate mixture to form an aqueous silicate solution. Once the aforementioned solutions are prepared, the heat exchanger is immersed within the aqueous cleaning solution and removed therefrom and subsequently immersed within the aqueous chromate solution and removing therefrom and finally, immersed within the aqueous silicate solution and removed therefrom. The process is characterized by maintaining the total concentration of chromate (300 BD) mixture within the aqueous chromate solution from 0.9 to 1.5 weight percent controlled to (+/−0.1%) depending age of bath and the 300 AD solution from 0.9 to 1.5 weight percent (+/−0.1%) thereby providing the necessary chemical concentration for producing a corrosion-resistent hydrophilic coating which is substantially free from odor emission.

By precisely maintaining the concentration levels of the cleaning solution, chromate solution, and silicate solution, a corrosive resistant hydrophilic coating is created which is substantially free from the musty odor typically associated with prior art coatings. It has been found that greater variations in the chromate solution are susceptible to produce a musty odor generally associated with the presence of microscopic organisms.

DESCRIPTION OF THE PREFERRED EMBODIMENT

The subject invention is a process for treating aluminum heat exchangers wherein heat exchangers are provided with a corrosive-resistent hydrophilic coating. The subject process includes sequentially immersing a heat exchanger in a plurality of serially arranged liquid baths containing chemical solutions. Such baths are of common construction and are well known in the surface treatment art. The heat exchangers treated by the subject surface treatment include aluminum therein and are typically automotive evaporators and radiators.

The baths are arranged serially wherein, the first bath contains an aqueous cleaning solution for cleaning the heat exchanger and for removing any oxidation thereon. The cleaning solution is an aqueous solution of nitric acid. More specifically, the cleaning solution includes a cleaning mixture comprising 40–60 weight percent of nitric acid and 1–5 weight percent of sodium fluoride, (commercially available from Circle-Prosco as Acid Cleaner 8D). Water is added to the cleaning mixture to form an aqueous cleaning solution having a total concentration of the cleaning mixture between 2.0–5.0 weight percent, (ideally 4.5 weight percent +/−0.2%). The bath is maintained at a temperature range of 120°–135° F.

A rinse water bath is positioned adjacent the cleaning bath and contains fresh rinse water for removing any residual cleaning solution remaining from the cleansed heat exchanger. Preferably two rinse water baths are provided for ensuring that substantially all of the residual cleaning solution is rinsed from the cleansed heat exchanger. Moreover, air blow-off mechanisms are preferable installed between the baths for blowing residual liquid from the heat exchanger back into the rinse bath the heat exchanger has previously been immersed in. Fresh water is continuously introduced into the rinse baths at a rate of approximately 10 gallons per minute in order to ensure the rinse water remains fresh.

A chromate bath is provided after the rinse bath(s) and includes an aqueous chromate solution. The chromate solution includes a chromate mixture and a chromate activator. The chromate mixture is 10 weight percent of chromium trioxide, 25 weight percent of nitric acid and 10–11 weight percent of hydrofluoric acid, (commercially available from Circle-Prosco as Alcoat 300 BD). The chromate activator is an aqueous mixture having less than 25 weight percent of molybdic acid and disodium salt (commercially available from Circle-Prosco as Alcoat 300 AD). The chromate mixture and chromate activator are mixed together and water is added thereto to form an aqueous chromate solution having a total concentration of the chromate (300 BD) mixture of 0.9 to 15 depending on age of solution weight percent (+/−0.1%) and a total concentration of the chromate activator (300 AD) concentration of 1.1 weight percent (+/−0.1%). The chromate bath should be maintained at a temperature between 120°–135° F. The overall concentrations of the chromate mixture and chromate activator in the chromate solution are critical for ensuring a musty odor-free coating.

At least one and preferable two rinse water baths are provided sequentially following the chromate bath for rinsing the chromate solution from the chromed heat exchanger. As with the previously mentioned rinse baths, air blow-off mechanisms can also be installed between the baths for further assisting in the removal of residual cleaning solution.

The silicate bath is provided including an aqueous silicate solution therein. The silicate solution includes a silicate mixture of 90–100 weight percent of silicate of soda and 0–10 weight percent of potassium hydroxide (commercially available from Circle-Prosco as Final Rinse 8D). Water is added to the silicate mixture to form a silicate solution having a total concentration of silicate mixture between 2.5–3.0 weight percent (+/−0.1%). The silicate bath should be maintained at a temperature between 155°–165° F. The overall concentration of the silicate solution in the silicate bath is critical and must be monitored and maintained within the specified range in order to avoid the emission of a musty odor from the coated heat exchanger.

The subject process includes successively immersing a heat exchanger in the liquid baths previously described. Automated conveying systems may be used for moving heat exchangers above the liquid baths and for successively immersing the heat exchangers within the baths. Alternatively, the heat exchangers may be manually immersed successively in the liquid baths. Regardless of the means used, the heat exchangers re preferably immersed in each liquid bath for approximately two minutes and fifty seconds.

The subject process includes immersing an aluminum heat exchanger into the cleaning bath and subsequently removing the heat exchanger from the cleaning bath and air blowing the residual cleaning solution therefrom. The heat exchanger is then immersed in the first rinse bath and then a second rinse bath where any residual cleaning solution is removed therefrom. The rinsed heat exchanger is then immersed within the chromate bath for and then removed therefrom where residual chromate solution is air blown from the chromed heat exchanger. Subsequently, the heat exchanger is successively immersed in two rinse baths to further remove residual chromate solution from therefrom. The rinsed heat exchanger is then immersed within the silicate bath and removed from the silicate bath where residual silicate solution is air blown from the heat exchanger. The heat exchanger is finally placed within a dry oven at a temperature of approximately 415° F.±5° F. for approximately 25 minutes.

Automated monitoring systems may be added to the baths to monitor the concentration levels of the various chemicals. Should the concentration of the chromate solution or silicate solution drift from the designated range or if contamination of the chemical bath occurs, additional chemicals may need to be added or the baths may need to be emptied and replenished with fresh solutions.

Although chemical concentrations of the cleaning, chromate, and silicate solutions, other than those specified, will produce corrosion-resistent hydrophilic coatings; it has been found that when the concentration of the chromate mixture (300 BD) is maintained at 0.9–1.5 weight percent (+/−0.1%); the chromate activator (300 AD) is maintained at 1.1 weight percent (+/−0.1%); and the silicate mixture of the silicate solution is maintained at 2.5 to 3.0 weight percent (+/−0.1%), the resulting coating is substantially free from the musty odor typically encounter with the prior art coatings.

What is claimed is:

1. A process for surface treating an aluminum heat exchanger by successively immersing the heat exchanger within a series of chemical solutions to provided the heat exchanger with a corrosive-resistent hydrophilic coating; the process comprising the steps of:

providing a cleaning mixture including 40 to 60 weight percent of nitric acid and 1 to 5 weight percent of sodium fluoride, adding water to the cleaning mixture to form an aqueous cleaning solution having a total concentration of cleaning mixture between 2.0 to 5.0 weight percent;

providing a chromate mixture including 10 weight percent of chromium trioxide, 25 weight percent of nitric acid and between 10 to 11 weight percent of hydrofluoric acid, providing a chromate activator comprising less than 25 weight percent of molybdic acid and disodium salt, adding water and the chromate activator to the chromate mixture to form an aqueous chromate solution;

providing a silicate mixture comprising 90 to 100 weight percent of silicate of soda and 0 to 10 weight percent of potassium hydroxide, adding water to the silicate mixture to form an aqueous silicate solution;

immersing the heat exchanger within an aqueous cleaning solution, and removing the heat exchanger from the cleaning solution;

immersing the cleansed heat exchanger in the aqueous chromate solution, and removing the heat exchanger from the chromate solution;

immersing the chromed heat exchanger in the aqueous silicate solution, and subsequently removing the heat exchanger from the silicate solution; and characterized by maintaining the total concentration of chromate mixture within the aqueous chromate solution at 0.9 to 1.5 weight percent (+/−0.1%) and the total concentration of chromate activator within the aqueous chromate solution at 1.1 weight percent (+/−0.1%) thereby providing the necessary chemical concentration for producing a corrosion-resistent hydrophilic coating which is substantially free from musty odor emission.

2. A method as set forth in claim 1 further characterized by maintaining the total concentration of the silicate mixture within the aqueous silicate solution between 2.5 to 3.0 weight percent (+/−0.1%).

3. A method as set forth in claim 2 further characterized by maintaining the total concentration of the cleaning mixture with the aqueous cleaning solution at 4.5±0.2% weight percent.

4. A method as set forth in claim 2 further characterized by removing residual cleaning solution from the cleansed heat exchanger immediately after removing the heat exchanger from the cleaning solution.

5. A method as set forth in claim 4 further characterized by removing residual chromate solution from the chromed heat exchanger immediately after removing the heat exchanger from the chromate solution.

6. A method as set forth in claim 5 further characterized by removing residual silicate solution from the heat exchanger immediately after removing the heat exchanger from the silicate solution.

* * * * *

UNITED STATES PATENT AND TRADEMARK OFFICE

CERTIFICATE OF CORRECTION

PATENT NO. : 5,234,714

DATED : August 10, 1993

INVENTOR(S) : Patel, et al

It is certified that error appears in the above-indentified patent and that said Letters Patent is hereby corrected as shown below:

ON THE TITLE PAGE, in Assignee block #73, insert --Chrysler Corporation--

Signed and Sealed this

Twenty-first Day of June, 1994

*Attest:*

Bruce Lehman

BRUCE LEHMAN

*Attesting Officer*

*Commissioner of Patents and Trademarks*